US005961011A

United States Patent [19]

Thomas et al.

[11] Patent Number: 5,961,011

[45] Date of Patent: Oct. 5, 1999

[54] DILUTION SYSTEM FOR FILLING SPRAY BOTTLES

[75] Inventors: John E. Thomas, River Falls, Wis.; Daniel K. Boche, Eagan, Minn.; John E. McCall, Jr., West St. Paul, Minn.; Eric R. Balz, Eagan, Minn.; Elizabeth J. Gladfelter, Roseville, Minn.; Daniel E. Pedersen, Cottage Grove, Minn.

[73] Assignee: Ecolab Inc., St. Paul, Minn.

[21] Appl. No.: 09/037,629

[22] Filed: Mar. 10, 1998

Related U.S. Application Data

[62] Division of application No. 08/782,413, Jan. 14, 1997, abandoned, which is a division of application No. 08/413, 782, Mar. 30, 1995, Pat. No. 5,597,019.

[51] Int. Cl.[6] ..... B65B 1/04

[52] U.S. Cl. ..... 222/541.6; 222/81; 222/88; 141/329

[58] Field of Search ..... 222/546.1, 541.7, 222/153.06, 81, 88; 141/329, 330

[56] References Cited

U.S. PATENT DOCUMENTS

| | | | |
|---|---|---|---|
| 3,443,726 | 5/1969 | Muller et al. | 222/80 |
| 3,595,442 | 7/1971 | Shapiro | 222/133 |
| 3,620,267 | 11/1971 | Seablom | 141/364 |
| 3,637,102 | 1/1972 | Shaw | 215/40 |
| 3,922,099 | 11/1975 | Christine et al. | 401/134 |
| 4,128,192 | 12/1978 | Coryell | 222/525 |
| 4,171,710 | 10/1979 | Boynton et al. | 137/238 |
| 4,173,858 | 11/1979 | Cassia | 53/471 |
| 4,201,316 | 5/1980 | Klingamen | 222/80 |
| 4,234,095 | 11/1980 | Safianoff | 215/232 |
| 4,307,821 | 12/1981 | McIntosh | 222/83 |
| 4,741,368 | 5/1988 | Crumby | 141/18 |
| 4,765,511 | 8/1988 | Clements | 222/83 |
| 4,867,326 | 9/1989 | O'Meara | 215/250 |
| 4,874,023 | 10/1989 | Ulm | 141/346 |
| 4,874,113 | 10/1989 | Schmidt | 222/143 |
| 4,898,293 | 2/1990 | Morel | 215/250 |
| 4,950,083 | 8/1990 | Bavaveas | 366/348 |
| 5,037,003 | 8/1991 | Bally et al. | 222/129.2 |
| 5,072,762 | 12/1991 | Jimenez | 141/329 |
| 5,174,343 | 12/1992 | Rood | 141/18 |
| 5,259,557 | 11/1993 | Spriggs et al. | 239/304 |
| 5,263,613 | 11/1993 | Billings | 222/129.1 |
| 5,269,354 | 12/1993 | Koberg | 141/105 |
| 5,351,892 | 10/1994 | Conte | 239/304 |
| 5,383,581 | 1/1995 | LeMarbe et al. | 222/459 |
| 5,392,828 | 2/1995 | Watson et al. | 141/330 |
| 5,435,467 | 7/1995 | Ekkert et al. | 222/109 |
| 5,443,094 | 8/1995 | Olson et al. | 137/892 |
| 5,505,235 | 4/1996 | Gorokhovsky et al. | 222/541.6 |
| 5,597,019 | 1/1997 | Thomas et al. | 141/330 |

FOREIGN PATENT DOCUMENTS

| | | |
|---|---|---|
| 0 279 971 | 8/1988 | European Pat. Off. . |
| 2 171 678 | 9/1981 | United Kingdom . |
| 2 127 387 | 4/1984 | United Kingdom . |
| WO 81/02418 | 9/1981 | WIPO . |
| WO 92/19528 | 11/1992 | WIPO . |

OTHER PUBLICATIONS

DEMA Blend Centers product literature (no available date).

Ecolab OASIS™ Complete Cleaning System brochure, "Good Food Isn't Enough", Copyright 1994, Ecolab Inc.

Ecolab OASIS™ Complete Cleaning System brochure, "A Comfortable Room Isn't Enough", Copyright 1994, Ecolab Inc.

*Primary Examiner*—Steven O. Douglas
*Attorney, Agent, or Firm*—Merchant & Gould P.C.

[57] ABSTRACT

Disclosed is a fitment for insertion into the neck of a container for liquid concentrate that can be opened by insertion of the container into a reservoir. The fitment comprises a substantially cylindrical body comprising an exterior mating surface that can sealingly engage the container and an internal web within the cylindrical body closing the fitment having a fracture zone permitting opening the fitment. The web also comprises a hinged fracture zone defined by a straight hinge portion and a partially circular recess in the web.

6 Claims, 6 Drawing Sheets

DILUTION SYSTEM FOR FILLING SPRAY BOTTLES

This application is a Divisional of application Ser. No. 08/782,413, filed Jan. 14, 1997, now abandoned, which is a Divisional of application Ser. No. 08/413,782, filed Mar. 30, 1995, now U.S. Pat. No. 5,597,019.

FIELD OF THE INVENTION

The invention relates to an apparatus for diluting a liquid concentrate with a diluent to form a liquid dilute use solution. The invention also relates to a station comprising one or more of such apparatus, each apparatus dedicated to a single liquid concentrate and dilute use solution. In conjunction with the apparatus, the liquid concentrate is packaged in a container adapted to use in the apparatus. The container has a closing means that can be opened by an opening means in the apparatus when inserted into a reservoir of the apparatus. The invention also relates to the concentrate container that, after emptying, can be used as a dilute use solution container.

The concentrate container can comprise a closing means to prevent leakage of the concentrate from the container during storage, shipment, etc. The closing means can comprise a flexible closing web or a rigid closing fitment.

Each use solution container comprises a unique mating surface that permits the use of the container with only an apparatus reservoir having a mating surface matched to the container mating surface. The dilution apparatus is adapted for use with aqueous, aqueous dispersions, aqueous reducible concentrates, or aqueous-alcoholic concentrates, that can typically be diluted with service water to dilute use solutions useful in typical institutional or industrial applications. The invention also relates to methods of using the apparatus.

BACKGROUND OF THE INVENTION

Dilution apparatus using an aspirator, to dilute a liquid concentrate with a liquid diluent to form a use solution, have been used for many years. The first such systems were ad hoc, loose assemblies of tubing, connections, aspirator, etc. The typical prior art diluting station comprises a large reservoir of concentrate, a source of diluent, typically service water, and a smaller receiving container for the dilute use solution. Typically, in general applications, the concentrate container is of large volume when compared to a use solution container. The concentrate container typically contains greater than five liters of concentrate while the container for the dilute use solution typically is relatively small, typically 500 milliliters to about 3 liters. The concentrate container can comprise a 5 to 10 liter plastic tote container, a 55 gallon drum or similar bulk volume container. The typical use solution container is a mop bucket, pail, spray bottle, etc.

Such a dilution apparatus is operated by passing service water or other aqueous stream through the aspirator containing a venturi. The venturi draws the liquid concentrate from the bulk into contact with the aqueous diluent stream, mixes the diluent and concentrate forming a use solution which is then transferred to a use solution container. The configuration of such a dilution apparatus has taken a large variety of embodiments. Large numbers of embodiments of concentrate containers, transfer mechanisms, aspirator control means, use solution containers and various combinations of these elements have been attempted in the past.

One such prior art diluting station is the DEMA blend center dilution system is designed to proportion concentrate from typically 5 gallon pail containers into a mop bucket. In this application, the mop bucket is a substantially different container than the concentrate container. Muller et al., U.S. Pat. No. 3,443,726 shows a mixing and dispensing container in which a first smaller concentrate container, after mating with a dilution container, opens the concentrate for liquid into the use solution container. The concentrate is dispensed into a diluent present in the container. The mated containers are agitated to mix the dilute use solution. Crumby, U.S. Pat. No. 4,741,368 shows returnable containers for liquid chemicals having a drum source of concentrate, a intermediate container and a delivery means to a spray applicator. Bavaveas, U.S. Pat. No. 4,950,083 teaches a package adapted for the use solution made from a liquid concentrate. The package contains means for measuring the concentrate for entry into the container for dilution. Schmidt, U.S. Pat. No. 4,874,113 shows a dispenser station for two or more cosmetic dispensers. Each dispenser having a container with a removable top for introduction of the cosmetic liquid material. These dispensers do not dilute a concentrate but deliver a premade lotion or gel. Bally, U.S. Pat. No. 5,037,003 teaches a dilution station having a large concentrate container and diluting means in a frame containing an apparatus that prevents unwanted operation of diluting valves. Conte, U.S. Pat. No. 5,351,892 shows a unitary multipurpose dilution and dispenser that directs a selected concentrate from a tote to a spray head. The apparatus permits selection of one of many specific concentrates for dispensing. Spriggs et al., U.S. Pat. No. 5,259,557 show a solution proportion and dispensing system that can dilute a product from a liquid concentrate container into a separate smaller reservoir or into a mop pail or other bucket. The manually operated aspirator can have a single dilution ratio. The diluted material stored in an intermediate container can be dispensed into use bottles fitted with spray heads.

In large part, the prior art dilution systems involve relatively large containers for concentrate when compared to the dilute use solution containers requiring different size containers for concentrate and dilute use solution. The prior art discloses systems comprising a concentrate container that is different than a use solution container. Such systems require a large inventory of different containers. Further, the prior art systems do not ensure the introduction of the appropriate concentrate into the concentrate container where multiple concentrate containers are used by a dilution station.

Accordingly, a substantial need exists for new versatile diluting apparatus and diluting stations having one or more diluting apparatus. Such stations ideally will permit concentrate container reuse as a dilute use solution container, reduce container inventory, reduce accidental mixing of concentrates, ensure proper dilution and filling of use solution containers and can be easily operated by maintenance personnel.

BRIEF DISCUSSION OF THE INVENTION

The invention resides in a dilution apparatus and in a dilution station comprising one or more of the dilution apparatus optionally combined with other useful features. The dilution apparatus is configured to dilutes a liquid concentrate, commonly an aqueous liquid concentrate with a liquid diluent such as service water, deionized water, softened water, heated water or other aqueous streams to form a use solution. The diluent passes through an aspirator containing an inlet for the liquid concentrate and a separate inlet for the liquid diluent. The aspirator also contains an outlet for the use solution formed by the action of the aspirator venturi in conjunction with the diluent and concentrate. The liquid concentrate is held within a reservoir having sufficient volume to permit convenient operation. The reservoir contains a liquid concentrate outlet that is directed, in fluid communication, to the aspirator inlet for the liquid concentrate. The reservoir also contains means to open a liquid concentrate container. The reservoir is shaped and configured to permit the insertion of the concentrate container. The reservoir preferably is shaped and configured to match the concentrate container such that other containers cannot be inserted in such a way that the opening means of the reservoir can actively open the container.

The liquid concentrate container is closed by a closing means. The closing means can comprise a flexible closure web or a rigid cylindrical closing fitment. Both the fitment and the flexible web are engineered to permit easy puncture of the web to permit drainage or transfer of the concentrate material into the reservoir.

The closing fitment has an easy-open feature. Preferably, the liquid concentrate container is inserted into the reservoir at an attitude such that, after opening, the concentrate flows into the reservoir. The mechanical force involved in inserting the container drives the container against means to open the container resulting in an open fitment. The liquid concentrate is transferred from the opened container through the open fitment, into the reservoir. When a volume of dilute use solution is desired, a mechanical, an electric or hydraulic controller is activated such that a measured volume of diluent passes through the aspirator venturi passing or drawing an appropriate amount of diluent and liquid concentrate from the reservoir mixing the concentrate with the diluent. The resulting use solution is collected in a use solution container placed in a container port. The use solution container and the concentrate container used in conjunction with the dilution apparatus are substantially identical. The fitment is preferably configured such that the concentrate container, when empty, can be inserted into a filling station in the dilution apparatus without physical modification of the container or interference with the dilution station. Alternately, if desired the fitment can be removed from the concentrate container before use. The container for the dilute use solution can also be returned to a source of concentrate, refilled with concentrate and fitted with a new fitment resulting in creation of a new concentrate container.

In a preferred mode of operating the dilution apparatus of the invention, the dilution apparatus comprises a container port or use solution container filling station comprising a defined space in the apparatus. The defined, preferably recessed space is configured to permit the insertion of a use solution container. The space is configured to support the use solution container and maintain its position during filling. As such, the space comprises a base portion and wall portions that are configured to surround and contain the use solution container. Substantially increased dimensions of the use solution container would prohibit insertion of the container into the filling station. Such a filling station can have the aspirator outlet positioned proximate to the top portion of the use solution container. The aspirator outlet can contain a flexible filling tube permitting insertion of the filling tube into the container prior to installation of the container in the filling station.

BRIEF DISCUSSION OF DRAWINGS

FIG. 1 is a generally side view of the apparatus that can be used to open a container for a liquid concentrate, dilute liquid concentrate using an aspirator and directing the diluted liquid concentrate, dilute use solution into a use solution container. FIG. 1 shows the liquid concentrate container and the use solution container are substantially identical.

FIG. 2 is a top view of the fitment used to seal the container for liquid concentrate. The opening is defined by a hinge zone and a fracture zone for opening the liquid concentrate container is shown. The fracture zone, when punctured by means to open the fitment, in the apparatus reservoir, leaves an opening that permits concentrate to flow into the reservoir from the container.

Figure 8:
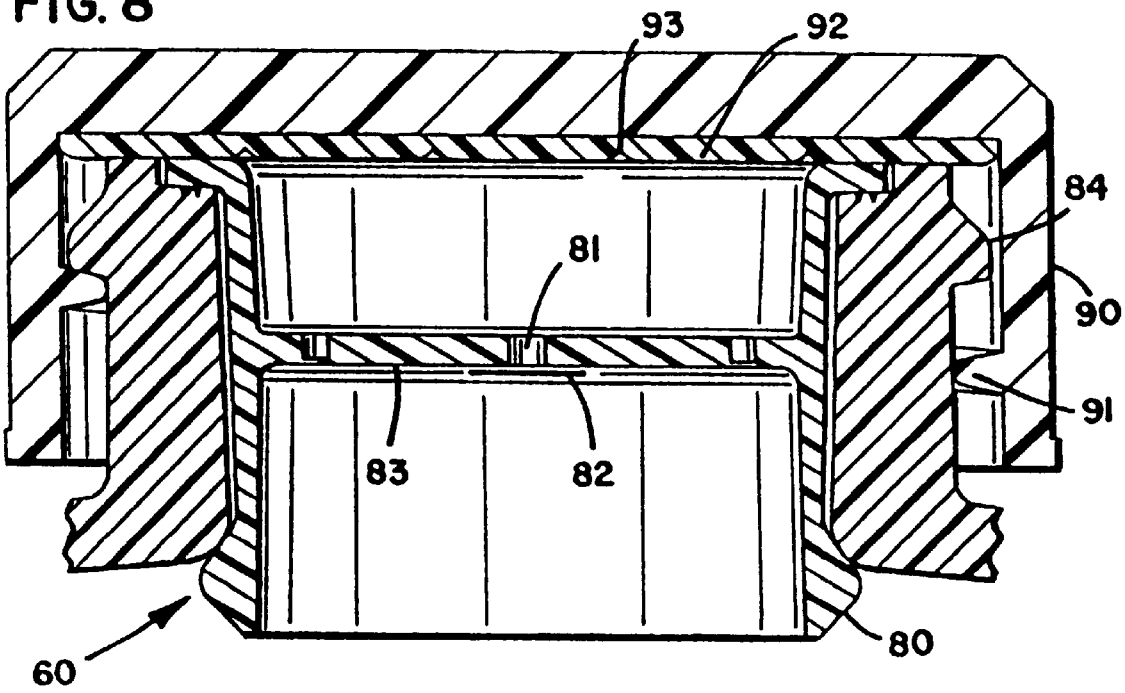

FIG. 8 is a cross sectional view of an embodiment of a matched cap, bottle and fitment of the concentrate/dilute use solution container of the invention. The fitment contains a vent comprising a hole and a hydrophobic flexible web. The bottle and fitment are closed with a vented cap having a vent permitting trapped vapors or gas to leave the container without the build-up of undesirable pressure.

DETAILED DISCUSSION OF THE INVENTION

The apparatus of the invention for diluting a liquid concentrate to a dilute liquid use solution contains an aspirator. Aspirators contain a venturi device driven by water pressure to draw a concentrate. The venturi device comprises a nozzle opening associated with a body of concentrate solution. The velocity of the diluent through the nozzle causes a reduction in pressure, draws the concentrate into the aspirator, generally causing a mixing of the concentrate and diluent typically at a fixed ratio depending on pressure, tubing sizes and length. Once diluted and mixed, the dilute use solution leaves the aspirator through an outlet for the dilute use solution. The outlet is in liquid communication with the use solution container. The aspirator is typically sized and adapted to diluent pressure that ranges from about 10 to about 60 psig. Preferably, service water is available in most municipalities at a pressure of about 20 to 40 psig. The apparatus of this invention works best at such a pressure. However, the apparatus can be adapted for a variety of water pressures. The apparatus is preferably assembled using components permitting a flow of diluent through the apparatus at about 1 to 4 gallons (about 3 to 20 liters per minute) per minute. The typical operation of the dilution apparatus typically results in the creation of greater than about 1 to 4 gallons of dilute use solution per minute. The concentrate materials of the invention include general purpose cleaning and sanitizing materials, coating compositions and other useful institutional or industrial liquid concentrates. Such materials include window cleaners, hand soap, hard surface cleaners, floor cleaners, sink cleaners, tile cleaners, drain cleaners and drain openers, glass cleaners, cleaners for food preparation units, sanitizers, disinfectants, aqueous coating compositions, water reducible concentrates, water reducible floor finishes, aqueous wax dispersions, air fresheners, odor counteractants, and other similar concentrates that can be formed as an aqueous solution, an aqueous alcoholic solution, an aqueous dispersion, an aqueous reducible solution or dispersion, etc.

The liquid concentrate materials useful for dilution to a dilute use solution typically comprise aqueous solutions, aqueous suspensions, aqueous reducible concentrates, aqueous alcoholic concentrates, etc., of cleaning or sanitizing chemicals. The concentrate can contain about 20 to 90 wt % of active cleaning materials. The typical viscosity of the liquid concentrates typically ranges from about 1 to 400 cP. The chemical systems can comprise a surfactant based cleaner, an antimicrobial, a floor finish, etc. The cleaner can be a generally neutral system, an acid-based system containing compatible surfactant, cosolvents and other additives or alkaline systems containing a source of alkalinity, compatible surfactants, cosolvents, etc.

Generally, neutral surfactant based systems are commonly based on an aqueous or aqueous/alcoholic solvent system and can use a variety of surfactants, thickeners, builders, dyes, fragrances, etc. to form the compositions of the invention. Useful solvent systems include lower alkanols such as methanol, ethanol, propanol, isopropanol; diols, polyols and ether diols such as ethylene glycol, cellusolves, carbitols, propylene glycol, hexylene glycol; polyethylene glycol, polypropylene glycol; organic bases such as monoethanolamine, diethanolamine, triethanolamine, etc. and others.

Typical acid systems are typically aqueous or aqueous solvent based systems containing an effective amount of an acid cleaning material. Both organic and inorganic acids can be used. Typical examples of useful acids include hydrochloric, phosphoric, acetic, hydroxyacetic, citric, benzoic, hydroxybenzoic, glycolic (hydroxyacetic), lactic, succinic, adipic, alkyl and aryl sulfonic acids, and other well known acid systems. These materials can be used in combination with well known compatible surfactant systems, thickeners, builders, dyes, cosolvents, etc. to form a fully functional material.

Alkaline systems are commonly aqueous or aqueous solvent systems combined with a source of alkalinity. Highly alkaline and moderately alkaline sources can be used. Useful alkaline sources include metal alkalis, organic bases, ammonium hydrates, amines, carbonates, salts, volatile amines, etc. Highly alkaline sources include sodium hydroxide, potassium hydroxide, etc. providing a large concentration of hydroxide ($OH^-$) in aqueous solution.

The neutral, acid or basic composition of the invention also generally comprises a surfactant. The surfactant may include any constituent or constituents, including compounds, polymers and reaction products that can alter surface tension in the resulting compositions, assist in soil removal and suspension by emulsifying soil and allowing removal through a subsequent flushing or rinse. Any number of surfactants may be used including organic surfactants such as anionic surfactants, cationic surfactants, nonionic surfactants, amphoterics and mixtures thereof.

Anionic surfactants such as alkyl sulfates and sulfonates, alkyl ether sulfates and sulfonates, alkyl aryl sulfates and sulfonates, aryl sulfates and sulfonates, and sulfated fatty acid esters, among others can be used in the concentrate of the invention.

Nonionic surfactants which have generally been found to be useful in certain optional formulas of the invention are those which comprise ethylene oxide moieties, propylene oxide moieties, as well as mixtures thereof. These nonionics have been found to be pH stable in acidic, neutral and alkaline environments, as well as providing the necessary cleaning and soil suspending efficacy.

One particularly useful surfactant for use in these systems include the amine oxide surfactants. Useful amine oxide surfactants have the formula:

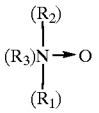

wherein $R_1$ is a $C_8$–$C_{20}$-alkyl or $C_8$–$C_{20}$-alkylamido-$C_2$–$C_5$-alkyl group and $R_2$ and $R_3$ are individually $C_1$–$C_4$-lower alkyl or hydroxy-$C_1$–$C_4$-lower alkyl.

The composition can also include a builder. Builders are materials which enhance the detersive effect of cleaning solutions and may be either organic or inorganic in composition. Builders may also exhibit properties of water conditioning and in some cases act as chelators and sequestrants. Builders useful in this invention include, but are not limited to, alkali metal or ammonia or substituted ammonia salts of carbonates, silicates, phosphates and borates, water soluble alkanolamines, substituted alkanolamines, as well as short chain carboxylic acids and their salts. Complex phosphates are common sequestering builders, sodium carbonate is a precipitating builder. Sodium aluminosilicate is an ion exchange builder. Other functions of builders include alkalinity supply to assist cleaning (especially of acid soils), supply buffering capacity to maintain alkalinity at an effective level, to prevent soil redeposition, and to emulsify oil and greasy soils. Commonly available organic or inorganic builder materials can be used. Such builders include sodium or potassium tripolyphosphate, sodium or potassium pyrophosphate, sodium or potassium orthophosphate, sodium carbonate, nitrilotriacetic acid, sodium salt, sodium citrate, carboxymethylmalonate, tartrate, mono- and di-succinates, oxydisuccinates, crystalline or amorphous aluminosilicates and mixtures thereof. Polycarboxylic homopolymers and copolymers such as the polyacrylic acid materials marketed as Acrysol® from the Rohm and Haas Company and acrylic-maleic anhydride copolymers marketed as Sokalan® from the BASF Corporation. These builder materials may be present at a level, for example, from 1 to 80 wt %, preferably about 5 to 60 wt %.

The cleaners of the invention can contain an antimicrobial agent consisting of a bacteriocide, a fungicide, a virucidal agent or any combination thereof in the dilutable concentrate. The selection is dependent upon end use. Examples of useful antimicrobial agents include halogens such as $Cl_2$, $Br_2$, or sources thereof such as NaOCl or NaOBr, fatty acids, peroxy fatty acids, aliphatic or aromatic sulfonic acids, hydrogen peroxide and other peroxy materials, glutaraldehyde, parachloro-meta-xylenol (PCMX), chlorhexidiene gluconate (CHG), 5-chloro-2-(2,4-dichlorophenoxy)phenol, alcohol, iodophores, povidone iodine, ethoxylated alkyl phenols, polyoxyethylene nonyl phenyl ether, phenolic compounds, chlorinated phenols, gluteraldehyde, quaternary compounds, etc. Quaternary ammonium compounds are also useful as antimicrobials in the invention are cationic surfactants including quaternary ammonium surfactants such as N-alkyl($C_{12-18}$) dimethylbenzyl ammonium chloride, N-tetradecyldimethylbenzyl ammonium chloride monohydrate, N-alkyl($C_{12-14}$) dimethyl 1-napthylmethyl ammonium chloride available commercially from manufacturers such as Stepan Chemical Company.

The composition can also include a sequestering or chelating agent including an alkali metal phosphate, a polyphosphate, a metaphosphate, polycarboxylic acids and their derivatives and salts, aminopolycarboxylic acids, and their salts, hydroxy carboxylic acids such as gluconic, citric, tartaric, lactic acid and gamma-hydroxybutyric acid, etc.

Useful formulas include the following general formulation and specific concentrates which include at least one best mode.

TABLE I

| Non-Acid Bathroom Cleaner Concentrate | |
|---|---|
| Soft Water | 20.2–40.0 |
| Alkalinity | 5.0–15.0 |
| Chelator/Sequestrant | 2.0–8.0 |
| Surfactant | 10.0–35.0 |
| Glycol Ethers | 5.0–25.0 |
| Fragrance | <5.0 |
| Dye | <1.0 |

TABLE II

| Non-Ammoniated Glass Cleaner Concentrate | |
|---|---|
| Deionized Water | 45.0–65.0 |
| Alcohol | 5.0–15.0 |
| Chelator/Sequestrant | 0.5–5.0 |
| Glycol Ethers | 5.0–15.0 |
| Surfactant | <5.0 |
| Dye | <1.0 |

TABLE III

| All Purpose Cleaner/Degreaser Concentrate | |
|---|---|
| Soft Water | 35.0–55.0 |
| Alkalinity | 5.0–15.0 |
| Chelator/Sequestrant | 1.5–6.0 |
| Surfactant | 15.0–30.0 |
| Glycol Ethers | 5.0–15.0 |
| Fragrance | <5.0 |
| Dye | <1.0 |

TABLE IV

| Ammoniated Floor Cleaner Concentrate | |
|---|---|
| Soft Water | 30.0–50.0 |
| Inorganic Alkalinity | 15.0–30.0 |
| Chelator | 5.0–15.0 |
| Surfactant | 5.0–1.50 |
| Ammonium Hydroxide | 3.0–10.0 |
| Fragrance | <5.0 |
| Dye | <1.0 |

TABLE V

Heavy Duty Non-acid Bathroom Cleaner

| FORMULA: | PERCENT | RAW MATERIAL |
|---|---|---|
| | 29.3 | Soft water |
| | 6.0 | Monoethanolamine 99% alkalinity |

TABLE V-continued

Heavy Duty Non-acid Bathroom Cleaner

| FORMULA: | PERCENT | RAW MATERIAL |
|---|---|---|
| | 4.9 | EDTA Acid, crystalline chelator |
| | 1.3 | Hydroxy ethylidene phosphoric acid DEQUEST 2010 chelator |
| | 7.5 | Cocoamidopropyl betaine surfactant |
| | 10.0 | Polypropylene glycol methyl ether acetate solvent |
| | 10.0 | Polypropylene glycol methyl ether acetate solvent |
| | 15.3 | Steol CS-460 sodium laureth sulfate surfactant |
| | 7.5 | Coco-dimethyl amine oxide Barlox 12 surfactant |
| | 8.0 | Monoethanolamine 99% alkalinity |
| | 0.2 | Lemon scent |
| | Trace | Dye |
| TOTAL: | 100.0 | |

TABLE VI

All Purpose Cleaner and Degreaser Concentrate

| FORMULA: | PERCENT | RAW MATERIAL |
|---|---|---|
| | 42.3 | Soft water |
| | 4.0 | Methyl carbitol (solvent) |
| | 4.0 | Sodium xylene sulfonate (40%) hydrotrope |
| | 12.0 | Emersol 221 73% oleic acid* |
| | 9.5 | Monoethanolamine alkalinity source |
| | 12.0 | Nonyl phenoxy ethoxylate, (bulk surfactant) |
| | 10.0 | EDTA (chelating agent) |
| | 6.0 | Hexylene glycol solvent |
| | 0.2 | Fragrance |
| | Trace | Yellow dye |
| TOTAL: | 100.0 | |

*Also contains 8% linoleic acid, 3% myristoleic acid, 1% linolenic acid, 4% palmitic acid, etc.

TABLE VII

Extra Strength Ammoniated Floor Cleaner Concentrate

| FORMULA: | PERCENT | RAW MATERIAL |
|---|---|---|
| | 45.3 | Soft water |
| | 28.0 | KOH (45% aqueous) base |
| | 9.4 | EDTA Acid chelator |
| | 4.0 | Barlox 12 surfactant |
| | 4.0 | Emcol CNP-110 alkyl aryl polycarboxylate surfactant |
| | 0.3 | Lemon Fragrance |
| | 4.0 | Ammonium hydroxide base |
| | 5.0 | Sodium xylene sulfonate (40% aqueous) hydrotrope |
| | Trace | Dye |
| TOTAL: | 100.0 | |

TABLE VIII

| Non-ammoniated Glass Cleaner Concentrate | | |
|---|---|---|
| FORMULA: | PERCENT | RAW MATERIAL |
| | 54.40 | Water, deionized |
| | 10.00 | Isopropanol 99% alcohol |
| | 0.60 | Sodium laureth sulfonate Steol CS-460 surfactant |
| | 2.40 | Tetrasodium EDTA liquid, (40% aqueous chelator) |
| | 0.40 | Nonyl phenol ethoxylate (surfactant) |
| | 32.20 | Ethylene glycol monobutyl ether, bulk solvent |
| TOTAL: | 100.00 | |

The reservoir for the liquid concentrate is in fluid communication with the concentrate inlet in the aspirator. The reservoir comprises means to hold a sufficient volume of the liquid concentrate to permit convenient operation of the apparatus. Typically, the maximum holding capacity of the reservoir is about 750 milliliters to 4 liters. The reservoir can be made from a variety of useful materials including thermoplastic materials, reinforced thermoplastic materials, thermosetting materials, structural metals, glass, fiberglass, etc. The preferred reservoirs comprise a mating surface adapted to the shape or configuration of the liquid concentrate container. Further, the reservoir contains means to open the liquid concentrate container having an openable fitment closing in the container.

The mating surface, for the concentrate container, used in the reservoir is shaped and configured to (1) support the concentrate container in position to permit the concentrate to transfer, drain or pass from the container into the reservoir or transfer to the reservoir, (2) ensure that the appropriate container and concentrate is inserted into the apparatus for its dilution and (3) and efficiently open the closing fitment sufficient to promote rapid transfer of the concentrate from the container into the reservoir.

The apparatus is typically adapted and configured to dilute a variety of liquid concentrates to useful dilute use solutions. The cross contamination of each apparatus reservoir within appropriate concentrate should be avoided. Acid cleaners can render basic cleaners inoperative. Further, the addition of a chlorine source to an acid can release inappropriate toxic fumes. A variety of other inappropriate interactions can occur resulting ultimately in a use solution that is not appropriate for its intended purpose. In order to prevent any cross contamination of the use solution from inappropriate concentrate, each concentrate container is shaped and configured to permit insertion of the container only into an appropriate reservoir containing a surface that mates only to the appropriate container. The preferred mating surfaces comprises a indentation on the concentrate container and comprises a complementary reservoir shape. The indentation is made on a non-symmetrical concentrate container. The concentrate container can be inserted in a single configuration into a single reservoir. The reservoir mating surface is shaped to conform itself to the overall shape of the container. The interaction between the mating surface in the bottle and indentation and the complementary reservoir shape ensures that only a specific concentrate container can be inserted into the reservoir. The mating surfaces positioned such that the concentrate container, after insertion into the reservoir is in a position such that the contents of the container are rapidly transferred into the reservoir.

In a preferred embodiment of the invention, the reservoir also contains a means to open a closure such as a flexible closure web or rigid closure fitment in the concentrate container. If the container is shaped and adapted to permit successful insertion of the container into the reservoir, the closing fitment in the concentrate container comes into contact with an opening means. The opening means pierces a closure fitment in the concentrate container.

The closure can comprise a flexible web or rigid cylindrical fitment. The flexible web can comprise a flexible thermoplastic film, a metal foil, or a paper sheet. A variety of thermoplastics can be used as the closure including polyethylene, polypropylene, polyethylene terephthalate or any other well known useful film. Metallic foils that can be used include aluminum foil, metallized polyester, etc. Paper webs that can be used include typical cellulosic sheets, cellulosic sheets treated with hydrophobic material such as silicone, thermoplastic coating materials, film or foil laminates, etc.

The closure fitment preferably comprises a circular or cylindrical insert. The insert sealingly fits into the opening of the concentrate container. The fitment contains typically a thermoplastic web closure. The thermoplastic web closure has an opening zone separated from the web by a fracture line defined by a hinge portion and a recessed, weakened line.

The puncture means easily punctures any flexible web closure. The puncture means in the reservoir contacts and causes the opening zone in the fitment to separate from the web at the fracture line which then swings away from the opening on the hinge portion. The web is typically a thermoplastic web having a thickness of about 0.2 to 5 millimeters. The fracture line is typically a line defined in the web as a substantially thinner portion (i.e., about 0.1 to 0.5 millimeters) with a hinge portion. The fracture line is preferably formed at the circumference of the web within the fitment and encloses a sufficient opening to permit an effective and rapid transfer of the contents of the reservoir. The opening comprises about 50% or more of the area of the thermoplastic web. The opening is further defined by a hinge portion defined in the fracture line upon which the material removed upon opening from the opening moves to open the thermoplastic web. If the fracture line is substantially less than 0.1 millimeter, the fracture line can leak inappropriately. If the fracture line is greater than about 0.5 millimeter or greater than about 50% of the thickness of the thermoplastic web, the opening zone can be difficult to puncture and remove from the fitment during opening. The preferred diameter of the fitment is about 10 to 50 millimeters. The thermoplastic web can be configured in a cylindrical insert portion having a height of about 10 to 60 millimeters. The rigid thermoplastic web within the fitment can be positioned within the fitment at any convenient location. The web can be positioned at the furthest exterior limit of the fitment, as close to the interior bottle portion of the fitment or can be positioned at the extreme exterior portion of the fitment when inserted in the bottle. The thermoplastic web is typically placed at some intermediate portion between the extreme ends of the fitment. Such position is typically used to promote ease of opening using the reservoir openings.

The preferred means to open the concentrate container is preferably positioned in the reservoir in a position such that the opening means contacts the opening zone and causes the thermoplastic web to fail at the fracture line permitting removal of the material in the opening zone to the closure.

By removal of the material in the opening zone, we mean that the material may be entirely removed at the fracture line and separated from the fitment. Such an opening protocol creates a circular portion of the closing web defined by the fracture zone that is removed entirely from the fitment leaving an opening through which the concentrate may pass. Alternatively, the term removal of the material can also connote displacement of the material from the opening zone while remaining attached to the fitment on a hinge portion. The opening means causes failure on the fracture line comprising a circular arc of substantially greater than 270°, preferably greater than 300° of the fracture zone leaving a hinge portion permitting the material to swing away from the opening zone creating a passage for the concentrate flow.

The dilute use solution is transferred from the aspirator outlet into the use solution container. The aspirator outlet can be positioned at the opening of the use solution container. In such a configuration the use solution exits the opening proximate to the neck of the bottle and then contacts the bottom of the container. If foaming of the use solution is a problem, the bottom of the container or the product delivery tube can be configured to minimize turbulence and foam generation. Alternatively, the aspirator outlet can be configured with a tube outlet transferring use solution to the bottom of the use solution container. Such a tube transfer configuration substantially reduces the likelihood of foam generation during filling operations.

Figure 5:
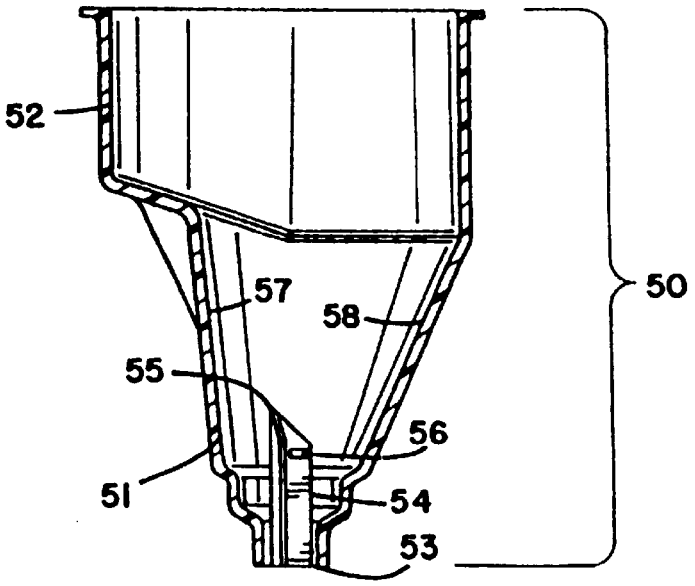
FIG. 5 is a cross-sectional view of the mating surface of the reservoir, containing means to open the fitment. The mating surface is adapted to the shape of the appropriate concentrate container and contains a piercing device that opens the fitment to ensure concentrate is transferred from the concentrate container to the reservoir.

Once opened, the contents of the container can then be efficiently and rapidly transferred into the container. The preferred configuration of the means to open the concentrate container is an elongate member having a sharp edge portion and which is extended into the fitment. The opening means can take a variety of cross-sectional shapes, including circular, triangular, rectangular, etc. A preferred two-surface angled shape is shown in FIG. 5. The preferred opening means contains a portion that ensures that material removed from the opening zone rotates on a hinge portion and is positioned away from the flow of concentrate into the reservoir. In certain configurations, the material removed from the opening zone can, under the influence of concentrate flow, fall back into the fitment partially or completely blocking flow. The opening means is preferably configured to ensure that the open container permits rapid and complete transfer of the concentrate into the reservoir.

The liquid concentrate held within the concentrate reservoir is in liquid communication with the concentrate input of the aspirator. The term "in liquid communication" indicates that the parts of the dilution apparatus are connected such that liquid flows between parts (e.g., from the reservoir to the aspirator) with little pressure drop and in the absence of substantial leaking. Preferred liquid communication means include flexible thermoplastic tubing, TYGON® tubing, PVC or CPVC rigid plastic tubing, or other suitable liquid conduit. Tubing diameters are important to ensure proper flow and typically are not less than 5 millimeters inside diameter. The liquid communication means are selected with a minimum length to ensure minimal pressure drop. The dilution ratio of liquid concentrate to diluent is typically about 0.1 to 40 parts of concentrate per each 100 parts of diluent, preferably 0.25 to 30 parts of concentrate per each 100 parts of diluent and most preferably about 0.5 to 25 parts of concentrate per each 100 parts of diluent. The dilution ratio can be selected by an appropriate selection of aspirator, tubing between concentrate container and aspirator. Control over dilution ratio can also be controlled by inserting a flow restriction device between the concentrate container and the aspirator concentrate inlet. Such a flow restricter, also known as a metering tip or metering valve, can be inserted at the reservoir outlet or at the aspirator inlet or any point between the reservoir and the aspirator in a transfer line. The diameter of the metering tip for regulating flow from the reservoir to the aspirator can be about 0.010 to 0.187 inch or about 0.25 to 4.75 millimeters and can be easily selected by measuring dilution ratio as the size of the metering tip varies from the smallest to the largest available diameter.

Liquid diluent is commonly combined with liquid concentrate in the aspirator to form the use solution. Liquid diluent is commonly an aqueous liquid. Useful aqueous liquids include common service water (distributed by local municipal water utilities), softened water, heated water, deionized water, distilled water, or other commonly available liquid streams in the institutional or industrial location. The typical liquid diluent is a liquid aqueous diluent comprising service water or heated service water. The plumbing code in the United States can in certain circumstances, recommend or require that the flow of service water be interrupted by a vacuum break if variations in water pressure in supply lines can cause the withdrawal of concentrate or dilute use solution into the service lines. When the apparatus of the invention is used in a dilution station containing one or more of the apparatus of the invention, the source of aqueous diluent can be a common manifold or common liquid source of the diluent material.

Flow of the aqueous diluent through the aspirator causes a reduction in pressure that draws the concentrate into the diluent stream resulting in the production of the dilute use solution. The flow of the diluent through the aspirator is controlled to ensure that the appropriate volume of dilute use solution is prepared by the action of the aspirator. The flow of diluent can be controlled in a number of ways. The diluent flow can be controlled by a simple hydraulic or electrically driven on/off switch that is energized by an operator who visually checks for appropriate fill volume. The switch is energized for a period sufficient to fill the use solution container with appropriately dilute use solution. The controller can also comprise a timer device programmed with inputs that result in an appropriate flow of diluent for a sufficient period of time to fill the container. Further, the controller can have input means transferring a signal derived from the container indicating the contents of the container to the controller. The input signal can be derived from a large variety of sensor devices that can sense weight, volume, fill or other condition of the container relating to required contacts. Once full, the sensor signals the controller to stop flow. The controller can also be a hydraulic energized control mechanism. Such a mechanism, once activated, will remain operational for a fixed period of time. The hydraulic timers typically contain passages that, through viscosity and flow, control the time the hydraulic controller remains open.

The apparatus of the invention typically includes a station for a use solution container positioned to receive the dilute use solution during the operation of the dilution mechanism. Such a station is in fluid communication with the aspirator outlet. In a preferred mode of operating the dilution apparatus of the invention, the dilution apparatus comprises a container port or use solution container filling station comprising a defined space in the apparatus. The defined, preferably recessed space is configured to permit the insertion of a use solution container. The space is configured to support the use solution container and maintain its position during filling. As such, the space comprises a base portion and wall portions that are configured to surround and contain the use solution container. Substantially increased dimensions of the use solution container would prohibit insertion of the container into the filling station. Such a filling station can have the aspirator outlet positioned proximate to the top portion of the use solution container. The aspirator outlet can contain a flexible filling tube permitting insertion of the filling tube into the container prior to installation of the container in the filling station.

When used in a dilution station, having one or more dilution apparatus, at least one apparatus contains a station for a use solution container. Other dilution apparatus can direct the flow of dilute use solution into a container other than the use solution container. The dilute use solution can be directed through a liquid communication means typically tubing or other conduit into a mop bucket or any arbitrary container.

The container for the liquid concentrate and the dilute use solution are substantially similar. By substantially similar, we mean that the container shape permits dual use (i.e., as a concentrate container and as a dilute use solution container). The container is configured to fit or match both the concentrate reservoir and the filling station.

The container can be sealed to prevent leakage of the concentrate from the container during shipment and storage using a closure means. The closure means can comprise a flexible web closure or a rigid fitment adapted to the container opening. Preferred flexible webs include thermoplastic films, metallic foils and paper webs. A preferred fitment comprises a cylindrical fitment having a rigid thermoplastic web having an opening zone defined by an easily fractured fracture zone defining a circular opening. A hinged fracture piece is removed from opening zone. The fitment (see FIGS. 3, 4 and 8) is inserted in the bottle neck and sealingly engages the interior of the bottle neck with the exterior of the cylindrical fitment. In a preferred mode, the fitment can be vented. The fitment can have a venting aperture in the fitment thermoplastic web preferably in the fracture zone. The vent can then be covered with a sealing means that permits the escape of gas or vapor from within the container without permitting the liquid to exit the container. Typical mechanical valve means can be used. Alternatively, a hydrophobic membrane can be used to seal the vent. The container, sealed by the flexible web or fitment, can have a cap installed to further seal the container. Conventional caps can be used that provide a further seal preventing the escape of any liquid or gas. Alternatively, a vented cap can be used. Vented caps comprise a typical cap construction having venting means. Useful venting means include an aperture in the cap or a permeable liner installed in the interior of the cap. The cap aperture can be covered with a hydrophobic film that acts to permit vapor or gas from the container to escape the cap while retaining any liquid. A preferred alternative is a porous liner permitting the escape of gas or vapor. A variety of such liners are available in the market place. Such liners comprise porous expanded thermoplastics, thermoplastic materials having waffled impressions in the surface of the thermoplastic, the venting apertures and other known venting means. Such caps are commonly used with the vented fitment alternative.

The preferred concentrate container can be inserted into the reservoir. The container surface matches the unique shape or configuration of the internal surface of the reservoir, and when inserted can be opened by the opening means in the reservoir causing drainage or transfer of the contents of the container into the reservoir. Once empty, the container then can be positioned at the filling station for the use solution container and can be filled with dilute use solution immediately after filling the reservoir or at any arbitrary time thereafter. The shape and configuration of the use solution container and the concentrate container are similar preferably identical. After the concentrate solution has been transferred into the reservoir, the container can be used with the fitment remaining in place. Optionally, the open fitment can be removed from the neck of the container. A spray head or other spray adapter mechanism can be inserted into the use solution container and can maintain the fitment in an open position permitting flow of the dilute use solution from the container. The container can have a liquid capacity of about 750 to 2000 milliliters, preferably 850 to 1000 milliliters. The container can also be adapted to the insertion of a spray head operated by manual compression of the trigger to deliver the use solution to a cleaning locus. This system of common containers for both the liquid concentrate and the use solution can permit recycle of accumulated containers for washing, refill and redistribution of the containers. Preferably, the containers are made of common thermoplastics including polyethylene, polypropylene, polyester, PVC, PET, etc.

DETAILED DESCRIPTION OF THE DRAWINGS

Figure 1:
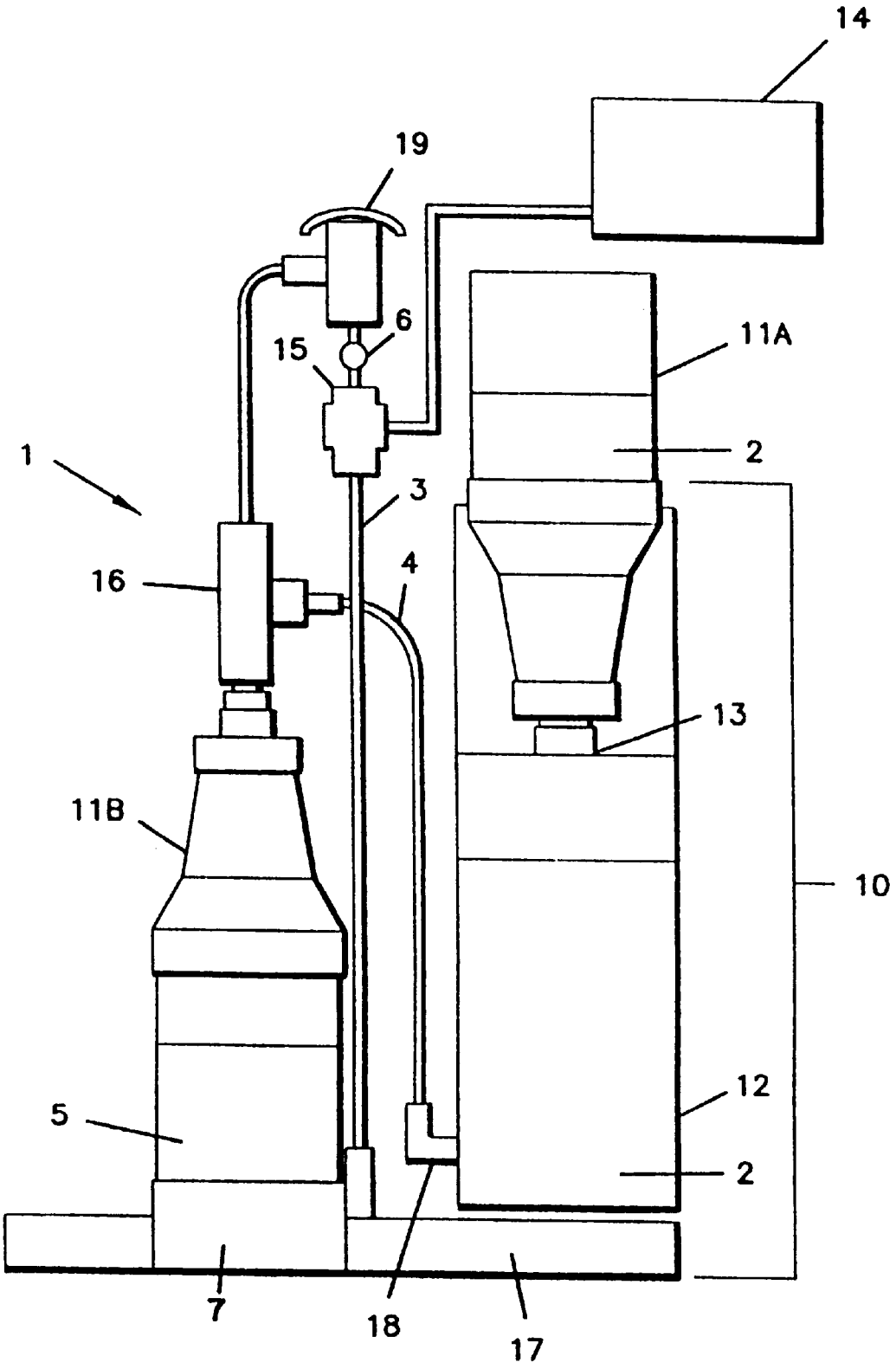

FIG. 1 shows a generally side view of the dilution apparatus/filling system of the invention. The dilution apparatus contains an aspirator 16 which operates by the action and flow of liquid diluent through the aspirator. Typically, the diluent comprises service or deionized water from a water inlet manifold 17 through venturi (not shown) in the aspirator 16 draws diluent. The aspirator 16 also draws liquid concentrate 2 by the action of the venturi (now shown) in the aspirator 16. Within the aspirator 16, the concentrate 2 and liquid diluent mix and form a dilute use solution 5 which is directed into a container 11B, installed in the apparatus at a filling station adapted to fit the container, generally at 1, containing dilute use solution 5. The apparatus also contains a liquid concentrate reservoir 10 comprising means to contain a volume of liquid concentrate 2 in a container 12. The concentrate reservoir also comprises a means 13 to support and open a liquid concentrate bottle 11A filled with liquid concentrate 2. The bottle opening means 13 typically comprises a puncture means cooperatively associated with the bottle support means in the reservoir. Liquid concentrate 2 is delivered to the aspirator 16 through a liquid communication means 4 such as a tube. Installed within the tube at some point between the concentrate container and the aspirator is an optional means 18 to control the volume of flow of the liquid concentrate 12. A preferred flow control means comprises a selected tube with a flow controlling internal diameter or a metering tip which can be installed at the concentrate reservoir outlet 18.

The apparatus additionally contains a source of liquid, aqueous diluent comprising an inlet water manifold 17 and fluid communication means 3 operatively connected with the aspirator 16. The flow of the aqueous diluent is controlled by valve 15 operated by a controller 14. The controller 14 comprises either a manually operated on/off switch, a hydraulic switch, an electric timer or a hydraulic timer programmed to introduce a controlled volume of dilute use solution 5 into the container 11B.

A sensor 6 is positioned proximate to the control valve 15 in order to sense that the apparatus contains liquid diluent to ensure appropriate operation of the dilution system resulting in useful dilute use solution.

The flow path of the aqueous diluent between the manifold 17 and the aspirator 16 additionally comprises a vacuum break 19 which prevents back flow contamination of dilute use solution 5 into the manifold 17 source of service water or deionized water.

The bottle filling system is operated by inserting the concentrate container 11A into the reservoir 10 transferring the concentrate 2 contents of the container 11A into the reservoir 12 through the action of opening means 13. When dilute use solution 5 is demanded by controller 14, the solenoid valve 15 is actuated permitting diluent under pressure to pass through the aspirator 16 drawing concentrate 2 into the aspirator 16 for mixing with the aqueous diluent. The mixed concentrate 2 and aqueous diluent forms a dilute use solution 5 within the diluent use solution container 11B. When the concentrate container 11A is empty, the container 11A can be removed from the reservoir 10 and can be installed at the filling station 7 as a use solution container 11B at the aspirator 16 to be filled with dilute use solution 5.

Figure 2:
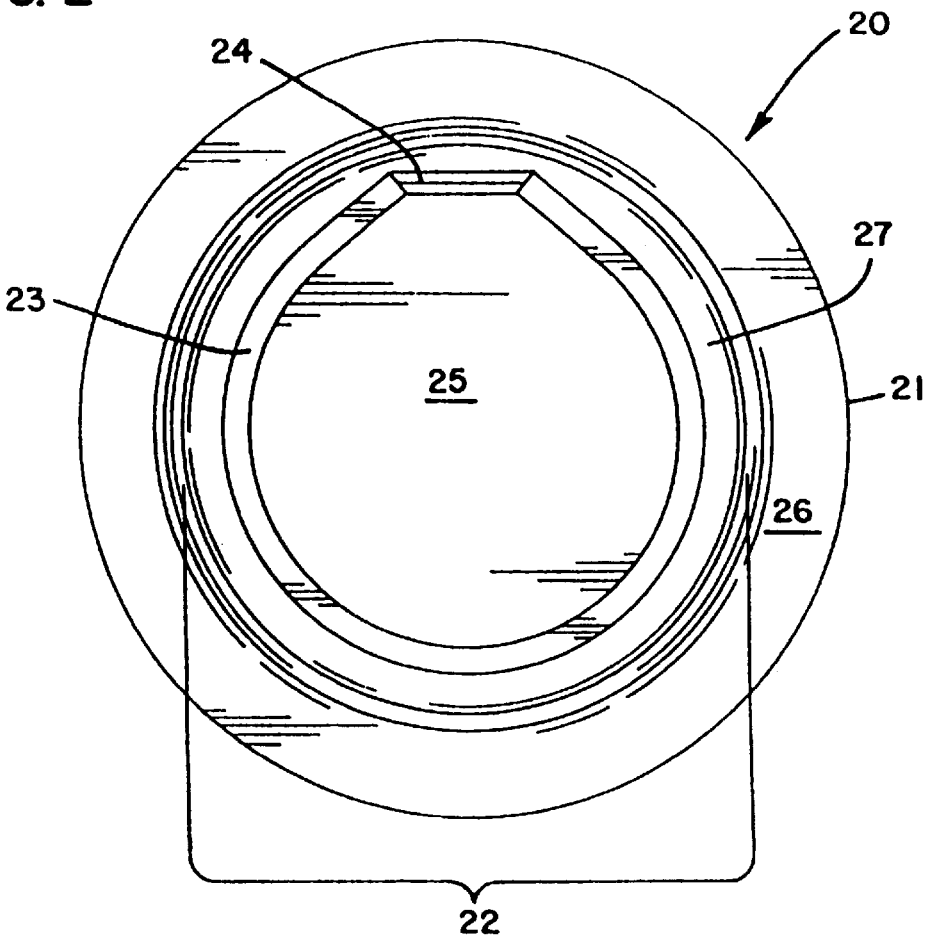

FIG. 2 is a top view of a fitment 20 that can be inserted into a container for the liquid concentrate that permits easy opening of the fitment by bottle opening means in the concentrate reservoir. The fitment comprises a substantially cylindrical body 21 surrounding a circular web closure 22 that closes the interior of the cylindrical member 21. The circular closure 22 contains a fracture line 23 in the closure web 22. The web 22 comprises an opening zone 25, a fracture line 23 and a web flange zone 27. The fracture line 23 is a recessed portion of the web adapted to failure when in contact with the opening means in the reservoir. The fracture line 23 comprises a substantially circular line. A portion of the circumference of the fracture line comprises a hinge portion 24. The hinge portion 24 is also a recessed zone in the web 22. However, the hinge recess zone is thicker than the fracture line 23. When opened, the hinge zone 24 maintains the closure 22 attached to the fitment to prevent plugging. The fitment also contains a flange 26 that sealingly engages the concentrate container opening.

Figure 3:
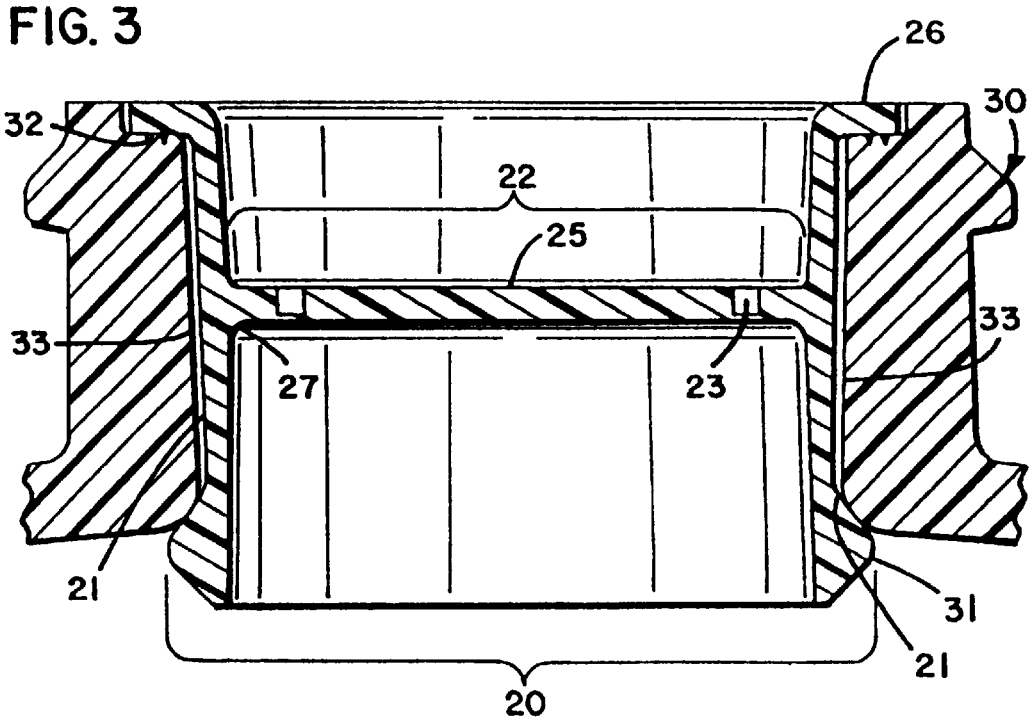
FIG. 3 is a cross-sectional view of the fitment of FIG. 2 inserted into a bottle or container.

FIG. 3 shows a cross section of the fitment of FIG. 2 inserted into the neck of a concentrate container 30. The exterior surface 21 of the cylindrical body fitment 20 sealingly contacts the inner wall surface 33 of the container 30. The fitment is held in place by flange 26 and projection 31 in contact with the interior of the bottle 30. The fitment is additionally secured by projections 32 holding the fitment in the bottle 30. The fitment comprises sealing web 22 containing fracture line 23 and the opening portion of the web 25 and web flange 27. In operation, the hinge portion 24 (see FIG. 2) holds the opening portion 25 within the fitment during emptying of the container.

Figure 4:
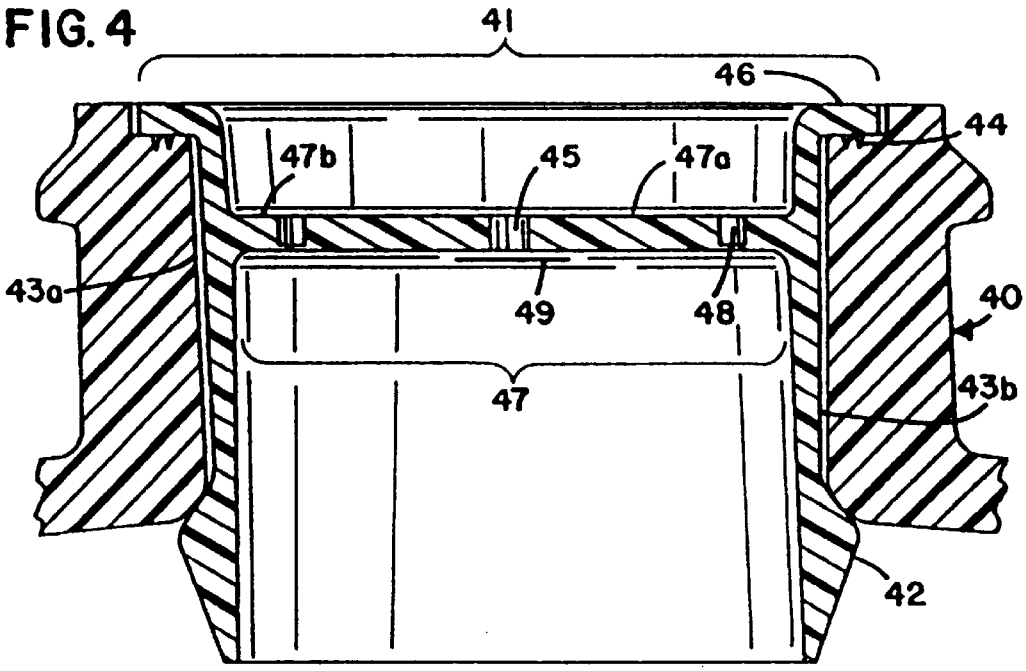
FIG. 4 is a cross-sectional view of a second embodiment of the fitment of FIG. 2 inserted into a bottle or container.

FIG. 4 shows a cross section of a second embodiment of a fitment 41 inserted into the neck of a concentrate container 40. The exterior surface of the cylindrical body fitment 43*b* sealingly contacts the inner wall surface 43*a* of the container 40. The fitment is held in place by flange 46 and projection 42 in contact with the interior of the bottle 40. The fitment is additionally sealed and secured by projections 44 holding the fitment in the bottle 40. The fitment comprises sealing web 47 comprising fracture line 48, opening zone 47*a*, web flange 47*b* and a vent aperture 45 sealed with a hydrophobic film 49. Sealing web 47, when opened by fracturing fracture zone 48, leaves a web flange 47*b* and an opening portion 47*a* which is removed completely or on a hinge member from the opening. Sealing web 47 also comprises an aperture 45 sized to permit escape of gases or vapors from the container. The aperture 45 is sealed by membrane 49. Membrane 49 is a hydrophobic membrane that can pass gas or vapor but substantially retains liquid.

FIG. 5 shows a cross-section of the mating surface and opening means portion of the reservoir (see FIG. 1). FIG. 5 shows generally the mating surface 50 conformed to adapt the shape or configuration of the concentrate container (see FIG. 6). The mating surface has portions 57 adapted to the handle portion, 51 to the neck portion of the bottle and 52 a body portion adapted to the body portion of the bottle. The mating surface 50 of the reservoir also comprises a drain portion 53 through which the contents of the concentrate container is transferred into a reservoir container. Operatively connected with the drain portion 53 is opening means 54 comprising a piercing end 55 and a tab 56. As the concentrate container is inserted into the mating surface 50, the fitment contacts the puncture means piercing end 55 which opens the fitment causing concentrate to drain from the bottle through the drain portion 53 into the concentrate reservoir container (not shown). The tab portion 56 maintains the fitment opening zone (not shown) positioned at an angle such that the flow of concentrate is not substantially reduced or interrupted during transfer of the concentrate into the reservoir container. We have found a variety of puncture means or opening means configurations that often fail to result in the complete transfer of the concentrate to the concentrate reservoir container. The angled or V-shaped opening means 54, piercing end 55 with the tab means 56 efficiently punctures the fitment opening the fracture zone and maintaining the opening in a position that the concentrate is efficiently transferred.

Figure 6:
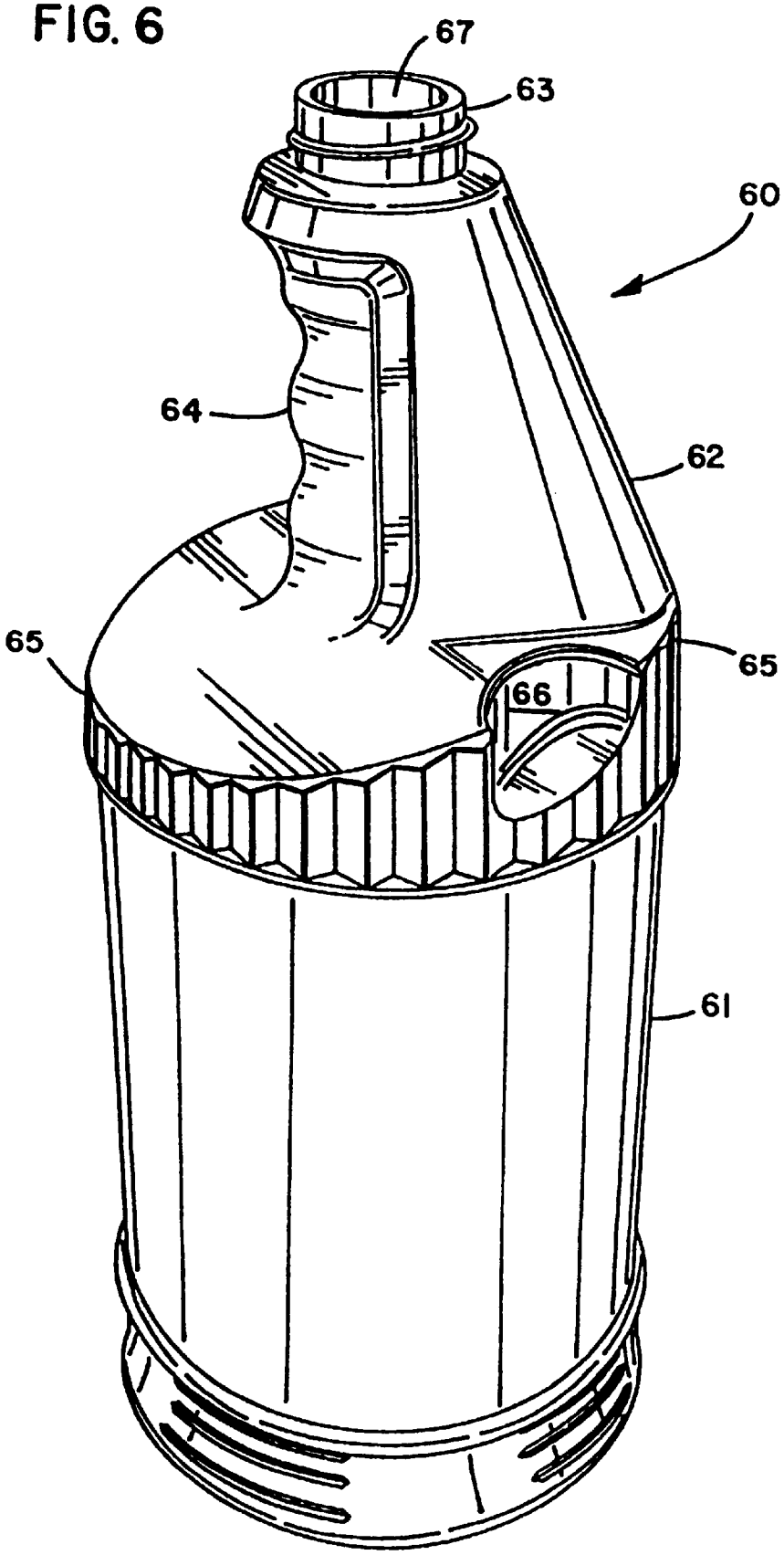
FIG. 6 is a view of a preferred dual function concentrate container/dilute use solution container.

FIG. 6 is a typical asymmetrical container for both the concentrate and the dilute use solution. The bottle 60 generally comprises a container body 61 and a neck portion 62. The neck portion 62 comprises a threaded opening 63 and an asymmetrical neck handle 64. The neck portion 62 is adapted to mate the mating surface 50 (see FIG. 5) to ensure that the bottle 60 can be inserted in a single configuration. The handle portion 64 of bottle 60 will fit in a single configuration to surface 57 of the mating surface 50 (see FIG. 5). Further, the neck portion 62 will fit the internal surface 58 of the mating surface (see FIG. 5). With a single mating configuration, a bottle indent 66 can be placed at any location on the shoulder 65 of container 60. Each concentrate material can have a unique placement of the indentation 66 and an associated complementary surface in the reservoir mating surface 50 (see FIG. 5). The fitment (see FIGS. 2–4) is inserted in the opening 67 of the bottle 60. After the concentrate is removed from the container 60, the fitment can be either retained in the neck or removed from opening 67 and a spray head or other dispensing means can be inserted into the bottle opening 67 for use.

Figure 7:
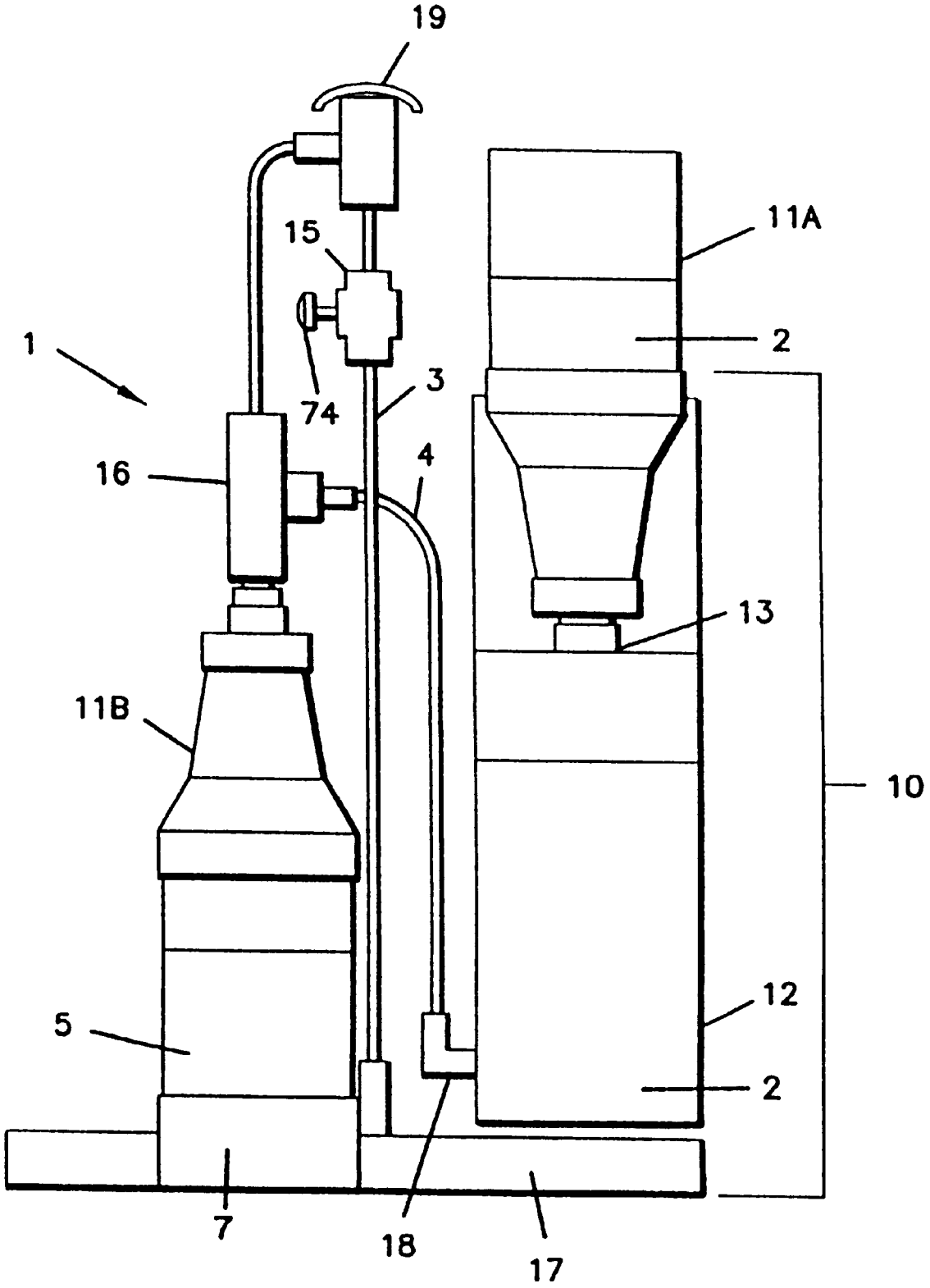
FIG. 7 is a general side view of a dilution apparatus substantially identical to FIG. 1 except that the apparatus of FIG. 7 uses an hydraulic-magnetic switch to actuate aspirator 15.

FIG. 7 is identical to FIG. 1 except with regard to the control means operating the apparatus of the invention. In this embodiment, water flows from a common manifold 17 through a supply line 3 into a valve 15 controlled by a hydraulic on/off switch 74. Pressing the switch 74 actuates a flow of diluent through the aspirator 16 drawing concentrate 2 for proper dilution. The dilution results in use solution 5 filling use solution container 11B. After filling operations are complete, the switch 74 can be withdrawn from its actuating position. Alternatively, the switch 74 can be spring loaded. Once pressure is removed from the switch 74, the spring loading mechanism (not shown) returns the switch to a position preventing flow of diluent.

FIG. 8 shows a cross sectional view of a closing fitment 80 inserted into the neck 84 of a container 60 (see FIG. 6). The container is closed with a cap 90. This configuration comprises a vented fitment and a vented cap. In FIG. 8, the container 60 is closed with a closing fitment 80 and capped by a cap 90. The closing fitment 80 contains a closure web 83 having an aperture 81 for venting gas or vapor from the container 60. The aperture 81 is closed using a flexible film 82. The hydrophobic film 82 permits the venting of gas or vapor but substantially prevents passage of any liquid material. The hydrophobic nature of the film is particularly useful in preventing passage of aqueous liquids. The container 60 is capped with cap 90. The cap 90 contains internal thread 91 that sealingly engage complementary threads 81 in the container 60. The cap contains a liner 92 having waffle indentations 93 forming vapor or gas vent means to permit venting the contents of the bottle during storage or transportation.

The invention is described in the drawings, specification and tables shown above. However, since the invention can be produced in many embodiments without departing from the spirit and scope of the invention, the invention resides in the claims hereinafter appended.

We claim:

1. A fitment for insertion into the neck of a container for liquid concentrate that can be opened by insertion of the container into a reservoir containing means to open the fitment, the fitment comprising a substantially cylindrical body comprising an exterior mating surface that can sealingly engage the container and an internal web within the cylindrical body closing, the fitment having a generally circular recessed fracture zone permitting opening the fitment; wherein the generally circular recessed fracture zone is defined by a recessed straight hinge portion and a recessed circular portion and the recessed straight hinged portion is recessed less than the circular portion.

2. The fitment of claim 1 wherein the fracture zone comprises a circular recess.

3. The fitment of claim 1 wherein the recess comprises less than 50% of the web thickness.

4. The fitment of claim 1 wherein the recess comprises less than 35% of the web thickness.

5. The fitment of claim 1 wherein the mating surface comprises a means to attach the fitment to a circular container opening.

6. The fitment of claim 1 wherein the internal web, within the cylindrical body closing the fitment, contains an aperture to vent gas or vapor from the container, the aperture being substantially sealed to the passage of liquid using a hydrophobic flexible web.

* * * * *